US009133015B2

(12) United States Patent
Taylor

(10) Patent No.: US 9,133,015 B2
(45) Date of Patent: Sep. 15, 2015

(54) LIQUID PUMP

(71) Applicant: Magic Tap, LLC, Cleveland, OH (US)

(72) Inventor: Curtis Taylor, Chagrin Falls, OH (US)

(73) Assignee: Magic Tap, LLC, Cleveland, OH (US)

( * ) Notice: Subject to any disclaimer, the term of this patent is extended or adjusted under 35 U.S.C. 154(b) by 0 days.

(21) Appl. No.: 14/257,474

(22) Filed: Apr. 21, 2014

(65) Prior Publication Data

US 2014/0252023 A1 Sep. 11, 2014

Related U.S. Application Data

(63) Continuation of application No. 12/792,287, filed on Jun. 2, 2010, now abandoned.

(60) Provisional application No. 61/183,719, filed on Jun. 3, 2009.

(51) Int. Cl.

| | |
|---|---|
| ***B65D 88/54*** | (2006.01) |
| ***B67D 7/64*** | (2010.01) |
| ***F04D 13/08*** | (2006.01) |
| ***B67D 1/00*** | (2006.01) |
| ***B67D 1/10*** | (2006.01) |
| ***F04D 13/06*** | (2006.01) |

(52) U.S. Cl.

CPC ..... *B67D 7/64* (2013.01); *B67D 1/0004* (2013.01); *B67D 1/10* (2013.01); *F04D 13/068* (2013.01); *F04D 13/086* (2013.01)

(58) Field of Classification Search

CPC ..... B67D 1/0004; B67D 1/10; B67D 7/64; F04D 13/16; F04D 13/08; F04D 13/086; F04D 13/068

USPC ..... 222/333, 385, 505, 567, 570, 1, 382, 222/383.1, 401, 464.1; 141/351, 360, 362; 417/423.3, 424.1; 220/211, 780, 220/790–794

See application file for complete search history.

(56) References Cited

U.S. PATENT DOCUMENTS

| | | | |
|---|---|---|---|
| 3,173,584 | A | 3/1965 | Giavasis |
| 4,060,182 | A | 11/1977 | Kikuchi |
| 4,116,366 | A | 9/1978 | Takenakashima et al. |
| 4,238,054 | A | 12/1980 | Chen |
| 4,274,562 | A | 6/1981 | Medeiros et al. |
| 4,310,104 | A | 1/1982 | Takatsuki |
| 4,429,813 | A | 2/1984 | DeFreitas |
| 4,440,328 | A | 4/1984 | DeFreitas |
| 4,464,983 | A | 8/1984 | Chappell et al. |

(Continued)

FOREIGN PATENT DOCUMENTS

| | | |
|---|---|---|
| DE | 202008004666 | 1/2009 |
| WO | 9408865 | 4/1994 |
| WO | 0166943 | 9/2001 |

*Primary Examiner* — J. Casimer Jacyna

(74) *Attorney, Agent, or Firm* — Fay Sharpe LLP

(57) ABSTRACT

A liquid pump creates a fountain type of dispenser for a container. The liquid pump includes a top portion, an elongated body and a bottom portion. The bottom portion at least partially includes an electric motor that is designed to draw fluid into the bottom portion when the electric motor is activated. The bottom portion is fluidly connected to the elongated body and the elongated body is fluidly connected to the top portion such that fluid that is drawn into the bottom portion is designed to flow out of the bottom portion and into the elongated body and then out of the elongated body and into the top portion.

19 Claims, 7 Drawing Sheets

(56) References Cited

U.S. PATENT DOCUMENTS

| | | | | | |
|---|---|---|---|---|---|
| 4,506,812 | A | | 3/1985 | DeFreitas | |
| 4,763,818 | A | | 8/1988 | Stefano et al. | |
| 5,104,012 | A | * | 4/1992 | McAllister et al. | 222/528 |
| 5,154,317 | A | | 10/1992 | Roppolo | |
| 5,377,871 | A | | 1/1995 | Banks et al. | |
| 5,921,441 | A | * | 7/1999 | Small et al. | 222/148 |
| 6,364,329 | B1 | | 4/2002 | Holub et al. | |
| 6,595,392 | B2 | | 7/2003 | Barnett | |
| 7,882,986 | B2 | | 2/2011 | Huang et al. | |
| 8,177,098 | B2 | * | 5/2012 | Penny | 222/111 |
| 2001/0030201 | A1 | * | 10/2001 | Gerhardt | 222/333 |
| 2006/0138162 | A1 | | 6/2006 | Anderson et al. | |
| 2009/0056363 | A1 | * | 3/2009 | Lee | 62/389 |
| 2010/0308083 | A1 | | 12/2010 | Taylor | |

* cited by examiner

LIQUID PUMP

The present invention is a continuation of U.S. application Ser. No. 12/792,287 filed Jun. 2, 2010, which in turn claims priority on U.S. Provisional Patent Application Ser. No. 61/183,719 filed Jun. 3, 2009, which is fully incorporated herein by reference.

The present invention is directed to a liquid pump, and more particularly to a beverage pump that converts a beverage container into a fountain-type dispenser.

BACKGROUND OF THE INVENTION

Large beverage containers are commonly used by the public. For example, gallon and half gallon containers of milk and juice are commonly purchased by consumers. In addition, juices and other beverages made from frozen or powdered concentrate are commonly made in half-gallon and gallon containers. Although purchasing and/or making beverages in large quantities can be cost effective for consumers, it can be difficult for certain individuals (e.g., small children, elderly adults, people with disabilities, people with arthritis, etc.) to lift and pour beverages from larger containers. Furthermore, there is increased incidence of dropping a large and heavy container or spilling a beverage from the large and heavy container when attempting to pour liquid out of the container. As such, many people decide to purchase smaller containers of beverages which are typically less economical.

In view of the current state of the art of containers, there is a need for a dispenser than can be used on a wide variety of containers to conveniently dispense the liquid in such container without having the user lift and pour the liquid from the container.

SUMMARY OF THE INVENTION

The present invention is directed to a liquid pump, and more particularly directed to a beverage pump. As can be appreciated, the liquid pump can be used to pump fluids other than beverages. The liquid pump of the present invention is particularly directed to a pump system that can be easily and conveniently used by consumers to dispense beverages from large containers (e.g, quart container, liter container, half gallon container, two liter container, gallon container, two gallon container, five gallon container, etc.). For purposes of this invention, large containers is defined as a container that can hold a quart or more of fluid. The liquid pump of the present invention is particularly useful in dispensing fluids from half gallon containers and larger containers. The liquid pump as described in the present invention enables a user to create a fountain type dispenser for a variety of containers so as to enable convenient dispensing of fluid from containers without having to lift and then pour a liquid from the container.

In one non-limiting aspect of the present invention, there is provided a liquid pump that includes a top portion, an elongated body and a bottom portion. The material and/or colors of the components of the liquid pump are non-limiting. Generally, the materials are durable, water resistant, and light weight. Non-limiting materials that can be used include plastic, rubber, etc. The shape of the top portion, an elongated body and a bottom portion are non-limiting. For example, the body of the top portion can include a circular, oval and/or polygonal cross-sectional shape the longitudinal length of the top portion; the elongated body can include a circular and/or oval cross-sectional shape along the longitudinal length of the elongated body; and the bottom portion can include a circular, oval and/or polygonal cross-sectional shape the longitudinal length of the bottom portion; however, this is not required.

In another and/or alternative non-limiting aspect of the present invention, the profile of the top portion is generally selected to be a low profile; however, this is not required. The low profile of the top portion, when used, enables the liquid pump to connect to the top of a container and still enable the liquid pump positioned on a container to be placed on the shelf of a refrigerator. Generally the maximum thickness of the top portion of the liquid pump is less than five inches. In one non-limiting design, the maximum thickness of the top portion of the liquid pump is less than four inches. In another non-limiting design, the maximum thickness of the top portion of the liquid pump is less than three inches. In still another non-limiting design, the maximum thickness of the top portion of the liquid pump is about 0.5-4 inches. In yet another non-limiting design, the maximum thickness of the top portion of the liquid pump is about 0.5-3 inches. In still yet another non-limiting design, the maximum thickness of the top portion of the liquid pump is about 1-3 inches. In another non-limiting design, the maximum thickness of the top portion of the liquid pump is about 1-2.5 inches. In still another non-limiting design, the maximum thickness of the top portion of the liquid pump is about 1-2 inches. In yet another non-limiting design, the maximum cross-sectional area of the top portion is generally greater than the cross-sectional area of an opening in a container; however, this is not required. When the maximum cross-sectional area of the top portion is greater than the cross-sectional area of an opening in a container, such a size relationship prevents the top portion from inadvertently falling through the container opening.

In still another and/or alternative non-limiting aspect of the present invention, the top portion of the liquid pump includes one or more dispenser activators such as, but not limited to, dispensing tabs, knobs and/or buttons. In one non-limiting embodiment of the invention, one or more dispenser activators can be positioned at least partially on one or more sides of the body of the top portion. The one or more dispenser activators can be used to activate the liquid pump and cause fluid in a container to be dispensed from the liquid pump. The one or more dispenser activators can be pivotable, rotatable, depressible, contact activated, etc.; however, it can be appreciated that the activation by the one or more dispenser activators can be accomplished by other or additional means. In one non-limiting design, at least one dispenser activator is positioned fully on or partially on the at least one side of the body of the top portion. The at least one dispenser activator is designed to activate the liquid pump when 1) a cup, glass etc. is pushed up against or otherwise contacts the at least one dispenser activator, and/or a user uses his/her finger to push up against or otherwise contact the at least one dispenser activator. A button, when used, can be depressible; however, this is not required. A dispensing tab, when used, can be depressible and/or pivotable; however, this is not required. A knob, when used, can be rotatable and/or depressible; however, this is not required. One or more of the dispenser activators can include a biasing arrangement (e.g., spring, flexible material, etc.) to bias the position of the at least dispenser activator in the non-activation position; however, this is not required. When a biasing arrangement is used, the biasing arrangement can be designed to cause the dispenser activator to move or switch from an activation position to a non-activation position. The activation position causes the liquid pump to energize one or more components in the liquid pump to enable the liquid pump to pump fluid at least partially through the liquid pump. In another and/or alternative non-limiting design, at least one dispenser activator is positioned fully on or partially on the top and/or bottom side of the body of the top portion. As can be appreciated, one or more dispenser activators can be positioned only on the side of the body, only on the top of the body, only on the bottom of the body, or any combinations thereof. As can also be appreciated, the body of the top portion can include two dispenser activators (e.g., button, etc.), one dispenser activator to activate the liquid pump, and one dispenser activator to deactivate the liquid pump; however, this is not required. The size and shape of the one or more dispenser activators are non-limiting. As can also be appreciated, a light sensor and/or motion sensor can also or alternatively be used to activate and/or deactivate the liquid pump; however, this is not required.

In yet another and/or alternative non-limiting aspect of the present invention, the top portion of the liquid pump can optionally include one or more visual indicators used to inform a user when the liquid pump is activated and/or deactivated. The visual indicator, when used, can be printed material (e.g., on, off, etc.) a light (e.g., green light indicates on, red light indicates off, etc.), and/or a tactile indicator (e.g., raised ribs, etc.). The one or more visual indicators can be located on any portion of the body of the top portion.

In still yet another and/or alternative non-limiting aspect of the present invention, the top portion of the liquid pump includes one or more dispenser heads that are used to dispense fluid from the liquid pump. The size and shape of the one or more dispenser heads is non-limiting. The one or more dispenser heads can be connected to the top, bottom and/or sides of the body of the top portion. The one or more dispenser heads can be fixed in a single position relative to the body of the top portion or be movable relative to the body of the top portion. In one non-limiting embodiment, the one or more dispenser heads are connected to the body of the top portion such that the one or more dispenser heads are not movable relative to the body. In another non-limiting embodiment, the one or more dispenser heads are connected to the body of the top portion such that the one or more dispenser heads are movable relative to the body. In such an arrangement, the one or more dispenser heads can be rotatably and/or pivotally connected to the body of the top portion. The movement of the one or more dispenser heads can be used to 1) position the one or more dispenser heads in a desired position relative to the body of the top portion so as to dispense fluid from the liquid pump, 2) deactivate/activate the liquid pump, and/or 3) allow/prevent flow of fluid through the one or more dispenser heads. When the one or more dispenser heads are movable, one or more visual (e.g., light, writing, arrow, marking, etc.), tactile (e.g., ribs, raised/depressed portion of body, etc.), and/or audible indicators can be used to inform a user about a desired or selectable position for the one or more dispenser heads; however, this is not required. A locking arrangement can be optionally used in association with the one or more movable dispenser heads to allow/prevent movement of the one or more dispenser heads relative to the body of the top portion. The one or more dispenser heads can be optionally angled upwardly and/or include an internal passageway that angles upwardly; however, this is not required. The upward angle, when used, is designed to cause fluid contained in the one or more dispenser heads to flow back toward the top portion and/or elongated body when the one or more motors are deactivate, thereby limiting or preventing fluid from dripping from the one or more dispenser heads after the one or more motors are deactivate. In one non-limiting design, the one or more dispenser heads are angled upwardly and/or an internal passageway in the one or more dispenser heads angles upwardly at an angle of about 0.5°-10° when a container that has a top opening and includes the liquid pump is placed on a flat surface. In another non-limiting design, the one or more dispenser heads are angled upwardly and/or an internal passageway in the one or more dispenser heads angles upwardly at an angle of about 1°-5° when a container that has a top opening and includes the liquid pump is placed on a flat surface. In still another non-limiting design, the one or more dispenser heads are angled upwardly and/or an internal passageway in the one or more dispenser heads angles upwardly at an angle of about 2°-3° when a container that has a top opening and includes the liquid pump is placed on a flat surface.

In another and/or alternative non-limiting aspect of the present invention, the top portion of the liquid pump can include one or more power sources. As can be appreciated, one or more power sources can be also or alternatively located in the elongated body and/or bottom portion of the liquid pump. The one or more power sources generally include one or more batteries and/solar cells; however, it can be appreciated that other or additional power sources can be used (e.g., electric plug, hand crank, etc.). In one non-limiting design, one or ore batteries are fully or partially positioned in the body of the top portion. In such a design, the top potion can optionally include a movable and/or removable battery cover on the body to enable a user to access the battery cavity in the body of the top portion so that the user can insert/remove one or more batteries from the battery cavity. The movable and/or removable battery cover, when used, can be positioned on the top, bottom and/or sides of the body of the top portion. As can also be appreciated, the orientation of the one or more batteries in the battery cavity is non-limiting. As can also be appreciated, the type of batteries is non-limiting (e.g., A, AA, AAA, watch battery, calculator battery, etc.). One or more surfaces of the battery cover can optionally include one or more ribs or other type of gripping structures to facilitate in the moving of the battery cover on the body so that a user can access the battery cavity. A locking arrangement can optionally be used in association with the battery cover to lock/unlock the battery cover to the body of the top portion.

In still another and/or alternative non-limiting aspect of the present invention, the liquid pump can optionally include a connector adaptor. The connector adaptor is designed to maintain the top portion 20 of the liquid pump on one or more fluid containers. Different containers can have different sized/shaped openings that allow a user to pour a liquid from the container. The connector adaptor is designed to be able to connect the top portion of the liquid pump to a variety of different sized container openings. The connector adaptor can also be designed to form a liquid seal between the top opening of container and a portion of the top portion of the liquid pump; however, this is not required. The color, shape and materials of the connector adaptor are non-limiting. The connector adaptor generally includes a cavity designed to receive at least a portion of a container that the liquid pump is to be connected. The cross-sectional shape of the cavity is non-limiting (e.g., circular, oval, polygonal, etc.). The cross-sectional size and/or shape of the cavity can be constant or vary along the longitudinal length or central axis of the cavity. The inner surface of the cavity can optionally include connection members (e.g., thread, ribs, etc.) for use in connecting the connector adaptor to a container; however, this is not required. The connector adaptor, when used, can be permanently or removably connected to the bottom and/or sides of the body of the top portion. The connector adaptor, when used, can optionally be designed to be threaded onto a container opening, snap connected onto a container opening, and/or frictionally engage a container opening. In one non-limiting embodiment, the connector adaptor is removably connected to the top portion for customized connecting of the liquid pump to a container; however, this is not required. In such an arrangement, multiple sized/shaped connector adaptors can be used to customized the connector adaptor for connection to a particular container opening. For example, a user merely selects a connector adaptor for a particular container the liquid pump is to be used with, and merely connects the connector adaptor to the top portion of the liquid pump. In another and/or alternative non-limiting embodiment, the connector adaptor is removably connected to the top portion for easy cleaning and/or replacement of the connector adaptor; however, this is not required. In still another and/or alternative non-limiting embodiment, the connector adaptor includes one or more removable inserts that can be used to customize the connector adaptor for connection to a particular container opening; however, this is not required. For example, a user merely selects a removable insert for a particular container the liquid pump is to be used with, and merely connects the removable insert to the connector adaptor so that the connector adaptor can be connected to the fluid connector. In still yet another and/or alternative non-limiting embodiment, the connector adaptor includes a plurality of sized cross-sectional shapes for the cavity of the connector adaptor along the longitudinal length or axis of the connector adaptor; however, this is not required. In one non-limiting configuration, the cavity of the connector adaptor has a uniformly decreasing diameter (e.g., cone-like shaped). In another non-limiting configuration, the cavity of the connector adaptor includes one or more landing ribs or steps such that the diameter of the cavity of the connector adaptor is decreased after each step. The different cavity diameters or cross-sectional areas of the connector adaptor enables the connector adaptor to be fitted on different sized openings on different types of containers. The landing ribs or steps are designed to engage the top lip of an opening of a container when the connector adaptor is fitted on the container opening so as to form a tighter and/or more secure connection between the connector adaptor and the container. In another and/or alternative non-limiting embodiment, the connector adaptor can optionally include one or more gripping elements (e.g., ribs or rough surfaces, etc.) or tabs to enable a user to easily grasp a portion of the connector adaptor to position the connector adaptor about an opening in a container and/or to remove the connector adaptor from an opening of a container. In another and/or alternative non-limiting embodiment, the connector adaptor can optionally formed of a flexible and/or stretchable material (e.g., rubber, etc.). For example, when one or more portions of the connector adaptor is formed of a flexible and/or stretchable material, the connector adaptor can be pulled and/or stretched (e.g., via the optional tabs, etc.) about an opening of a container. In another and/or alternative example, the flexible and/or stretchable material on the connector adaptor can enable a user to roll up a portion of the connector adaptor to as to facilitate in positioning the connector adaptor about the opening of a container.

In yet another and/or alternative non-limiting aspect of the present invention, the liquid pump includes a bottom portion that is designed to be inserted through an opening in a container and be partially or fully submerged in a liquid in the container. The bottom portion shape, size and materials are non-limiting. Generally the bottom portion is formed of a lightweight, durable water resistant material (e.g., plastic). The length of the bottom portion is selected so that it can be fully inserted into a container; however, this is not required. In one non-limiting embodiment, the bottom portion has a longitudinal length of at least about 0.25 inches and generally no more than about 10 inches. In one non-limiting design, the bottom portion has a longitudinal length of about 0.5-6 inches. In another non-limiting design, the bottom portion has a longitudinal length of about 1-4 inches. The longitudinal length of the bottom portion is generally equal to or less that the longitudinal length of the elongated body; however, this is not required. In one non-limiting design, the ratio of the longitudinal length of the bottom portion to the longitudinal length of the elongated body is about 0.05-1:1. In another non-limiting design, the ratio of the longitudinal length of the bottom portion to the longitudinal length of the elongated body is about 0.1-0.5:1. In still another non-limiting design, the ratio of the longitudinal length of the bottom portion to the longitudinal length of the elongated body is about 0.2-0.4:1. The cross-section size and shape of the bottom portion is also non-limiting; however, the size and shape should be selected so that the bottom portion can be inserted into a variety of container openings. In another and/or alternative non-limiting embodiment, the bottom portion has a generally circular cross-sectional shape and has a maximum diameter of about 0.1-3 inches. In another non-limiting design, the bottom portion has a generally circular cross-sectional shape and has a maximum diameter of about 0.25-2 inches. In still another non-limiting design, the bottom portion has a generally circular cross-sectional shape and has a maximum diameter of about 0.5-1.5 inches. The maximum cross-sectional area of the bottom portion can be greater, equal to or less than the maximum cross-sectional area of elongated body. In one non-limiting design, the ratio of the maximum cross-sectional area of the bottom portion to the maximum cross-sectional area of elongated body is about 0.5-3:1. In another non-limiting design, the ratio of the maximum cross-sectional area of the bottom portion to the maximum cross-sectional area of elongated body is about 0.75-2:1. In still another non-limiting design, the ratio of the maximum cross-sectional area of the bottom portion to the maximum cross-sectional area of elongated body is about 1-1.8:1. In yet another non-limiting design, the ratio of the maximum cross-sectional area of the bottom portion to the maximum cross-sectional area of elongated body is about 1.01-1.75:1. In still another and/or alternative non-limiting one embodiment, the bottom portion has a weight and density that is generally selected so that the bottom portion will sink in water and in most beverages that a consumed by humans; however, this is not required. As such, the average density of the bottom portion is generally greater than the density of water at 77° F. such that the bottom portion will naturally sink in the water. In yet another and/or alternative non-limiting one embodiment, the bottom portion has one or more openings designed to enable fluid in a container to be drawn to the interior of the bottom portion. The location, shape and size of the one or more openings on the bottom portion is non-limiting. In one non-limiting design, the bottom portion includes at least one opening at the bottom end of the bottom portion. One of the openings can be centrally located in the bottom end; however, this is not required. The one or more openings can be circular; however, it can be appreciated that the one or more openings can have cross-sectional shapes other than a circular shape. As can also be appreciated, the one or more openings can be positioned on other or additional locations on the bottom portion (e.g., one or more openings can be positioned on the side of the bottom portion, etc.).

In yet another and/or alternative non-limiting aspect of the present invention, the liquid pump includes optionally one or more electric motors. The electric motor is designed to 1) draw fluid into the bottom portion, 2) cause fluid to travel up through the elongated body, 3) cause fluid to flow to the top portion and out of one or more dispenser heads on the top portion. In one non-limiting embodiment of the invention, the one or more electric motors can be partially or fully located in the top portion, the elongated body and/or the bottom portion. In one non-limiting design, the one or more motors are partially or fully positioned in the elongated body and/or bottom portion. In another and/or alternative non-limiting design, the one or more motors are partially or fully positioned in the bottom portion. In still another and/or alternative non-limiting design, the liquid pump includes a single motor that is partially or fully positioned in the elongated body and/or bottom portion. In yet another and/or alternative non-limiting design, the liquid pump includes a single motor that is fully positioned in the bottom portion of the liquid pump. The positioning of the motor fully or partially in the bottom portion of the liquid pump can result in the sound generated by the operation of the motor to be significantly muffled, especially when the bottom portion is partially or fully immersed in fluid in a container; however, this is not required. The one or more motors generally include one or more blades that are rotated by the electric motor so as to cause fluid to flow through the liquid pump. As can be appreciated, the electric motors can be used to also to alternatively power one or more pistons that cause fluid to flow through the liquid pump. In another and/or alternative non-limiting embodiment of the invention, the one or more electric motors are generally sealed from the fluid that enters the liquid pump; however, this is not required. The sealing of the one or more motors has one or more advantages, namely 1) the electric motor is not damaged by the fluid, 2) the fluid is not contaminated by the motor, 3) the portion of the liquid pump that includes the one or more motors can be partially or fully submerged in fluid. In one non-limiting design, one or more sealing rings are used to isolate the one or more electric motors from liquid flowing through the liquid pump. In another and/or alternative non-limiting design, one or more chambers located in the top portion, the elongated body and/or the bottom portion are designed to fully or partially contain the one or more motors and to fully or partially isolate the one or more electric motors from liquid flowing through the liquid pump. For example, the bottom portion of the liquid pump can include a chamber that houses a single motor and includes an opening for the shaft of the motor to extend therethrough, which opening includes a sealing ring to create a liquid seal between the motor shaft and the opening in the chamber. Such a chamber can be centrally located on the bottom portion; however, this is not required.

In still yet another and/or alternative non-limiting aspect of the present invention, the liquid pump includes an elongated body connected between the top portion and the bottom portion of the liquid pump. The elongated body includes one or more channels along the longitudinal length of the elongated body so that fluid can flow from the bottom portion, through the elongated body and to the top portion of the liquid pump. The elongated body can be a separate component or be integrally formed with the top portion and/or the bottom portion. The length, shape, cross-section shape, color and/or materials of the elongated body is non-limiting. The elongated body can be partially or fully formed of a flexible material (e.g., plastic, etc.); however, this is not required. In one non-limiting embodiment, the elongated body is a separate component from the top portion and/or the bottom portion of the liquid pump. The elongated body can be designed to be permanently or detachably connected to the top portion and/or the bottom portion of the liquid pump. When the elongated body is connected to the bottom portion, the elongated body is fluidly connected to one or more openings in the bottom portion. Generally the bottom portion includes one or more openings in the top of the bottom portion that allows fluid to flow out of the bottom portion after the fluid has been drawing into the bottom portion; however, it can be appreciated that one or more openings can be positioned on other or additional regions of the bottom portion. In one non-limiting design, the bottom portion includes a single top opening and a bottom portion of the elongated body is designed to be inserted into the top opening or be fitted about the top opening in the bottom portion. In another and/or alternative one non-limiting embodiment, the elongated body has a generally cylindrical shape; however, the elongated body can have other or additional shapes. The cross-section shape and size of the elongated body can be generally uniform along the longitudinal length of the elongated body; however, it can be appreciated that the cross-section shape and/or size of the elongated body can vary along the longitudinal length of the elongated body. The length of the elongated body is non-limiting. In one non-limiting design, the elongated body has a length of about 1-25 inches. In another non-limiting design, the elongated body has a length of about 2-20 inches. In still another non-limiting design, the elongated body has a length of about 6-14 inches. The cross-section size of the elongated body is also non-limiting. In one non-limiting design, when the elongated body has a circular cross-section shape, the diameter is about 0.1-3 inches. In another non-limiting design, when the elongated body has a circular cross-section shape, the diameter is about 0.25-2 inches. In still another non-limiting design, when the elongated body has a circular cross-section shape, the diameter is about 0.5-1.25 inches. In still another and/or alternative one non-limiting embodiment, one or more portions of the elongated body can be designed to be flexible and/or be formed of a flexible material; however, this is not required. When the elongated body is designed to be partially or fully flexible, such a design allows the elongated body to be more conveniently positioned in different shaped and sized containers. In one non-limiting design, the elongated body is formed of a flexible tubular material. The tubular material can be clear, partially clear, or colored to prevent viewing of the interior of the elongated body. In still yet another and/or alternative one non-limiting embodiment, one or more electric wires can partially or fully extend through the elongated body; however, this is not required. For example, when one or more electric motors are located in the elongated body and/or the bottom portion, and the power supply is located in the top portion, elongated body and/or the bottom portion, one or more electric wires are required to be within the elongated body and/or along the outside of the elongated body. In one non-limiting design, when the power supply for the one or more electric motors is separated from the one or more electric motors that are partially or fully positioned in the elongated body and/or bottom portion the liquid pump, one or more electric wires are positioned in one or more portions of the interior of the elongated body so as to electrically connect to one or more electric motors to the power supply. When one or more electric wires are positioned in one or more portions of the interior of the elongated body, the one or more electric wires can be isolated from fluid that flows through one or more passageways in the interior of the elongated position that are used to allow fluid to flow through the elongated body; however, this is not required. The isolation of the one or more electric wires has one or more advantages, namely 1) the one or more electric wires are not damaged by the fluid, and/or 2) the fluid is not contaminated by the one or more electric wires. The isolation of the one or more wires, when used, can be achieved in several ways such as, but not limited to, 1) creating a separate passageway in the interior of the elongated body for the one or more electric wires which separate passageway is not in fluid communication with the one or more passageways for the fluid, 2) encase the one or more electric wires in a tubing or other type of material, which tubing or material, and/or 3) coat the one or more electric wires with a coating (e.g., plastic coating, etc.). When a coating or tubing is used, such coating or tubing is generally water resistant and does not reactor or contaminate water or other types of beverages for human consumption. In one non-limiting design, a tube is positioned in the at least one of the fluid passageways in the interior of the elongated body. One or more electric wires are positioned in the tube so as to isolate the one or more electric wires from any fluid that flows in the fluid passageway that includes the tube.

One non-limiting object of the present invention is the provision of a liquid pump that can be used to enable convenient dispensing of fluid from containers without having to lift and then pour a liquid from the container.

Another and/or alternative non-limiting object of the present invention is the provision of a liquid pump that can to convert a container into a fountain-type drink dispenser.

Still another and/or alternative non-limiting object of the present invention is the provision of a liquid pump that includes a motor in the base portion to pump fluid upwardly through an elongated body and to the top portion of the liquid pump.

Yet another and/or alternative non-limiting object of the present invention is the provision of a liquid pump that includes connector adaptor that can be used to connected the liquid pump to different sized openings in containers.

These and other objects and advantages will become apparent from the following description taken together with the accompanying drawings.

BRIEF DESCRIPTION OF THE DRAWINGS

Reference may now be made to the drawings, which illustrate several non-limiting embodiments that the invention may take in physical form and in certain parts and arrangements of parts wherein.

DETAILED DESCRIPTION OF NON-LIMITING EMBODIMENT

Figure 1:
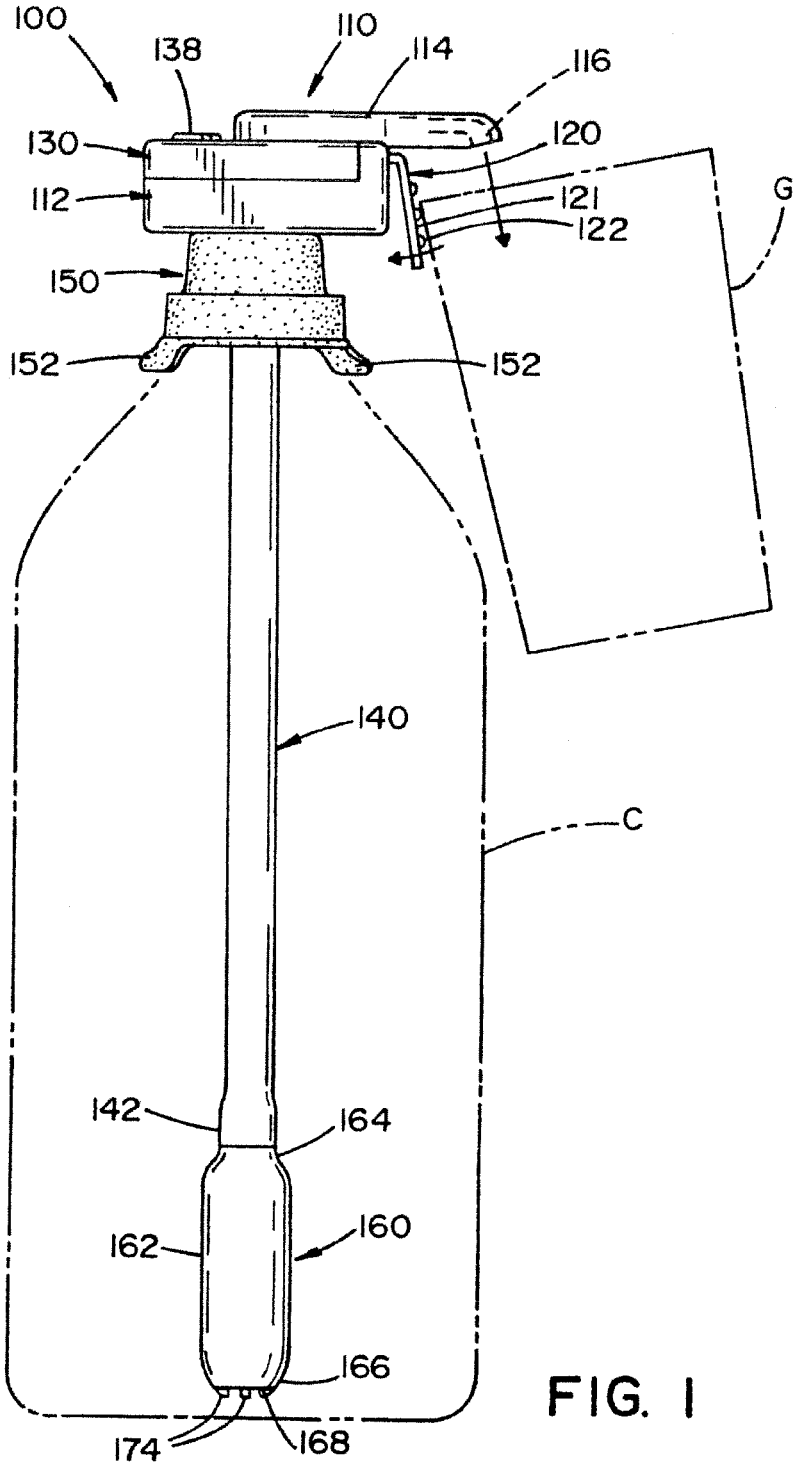
FIG. 1 is a side view of one non-limiting embodiment of the liquid pump of the present invention.
Figure 2:
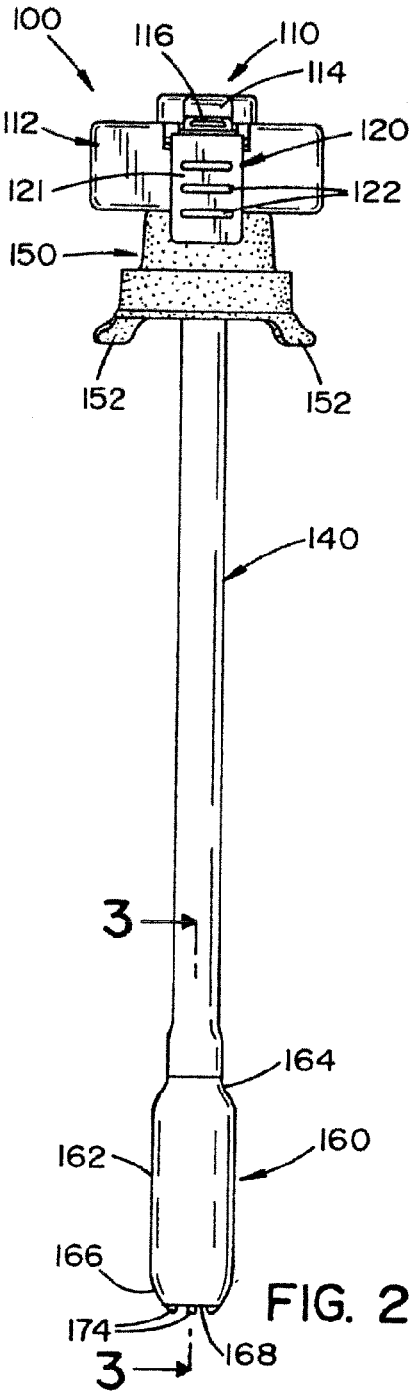
FIG. 2 is a front view of the liquid pump illustrated in FIG. 1.

Referring now to the drawings wherein the showings are for the purpose of illustrating non-limiting embodiments of the invention only and not for the purpose of limiting same, FIGS. 1-10 illustrate one non-limiting embodiment of the liquid pump in accordance with the present invention. Referring now to FIG. 1, there is illustrated a liquid pump 100 that is designed to dispense fluid, not shown, from a container C into a glass G, cup or the like. The type of container that the liquid pump can be used with is non-limiting. A variety of liquids can be dispensed by the liquid pump. Most liquids consumed by humans (e.g., water, fruit juice, vegetable juice, milk, soda, energy drinks, protein drinks, tea, coffee, etc.) can be dispensed by the liquid pump. The liquid pump of the present invention enables a user to create a fountain type dispenser for a variety of containers so as to enable convenient dispensing of fluid from containers without having to lift and then pour a liquid from the container.

The liquid pump 100 includes a top portion 110, an elongated body 140 and a bottom portion 160. The materials and/or colors of the components of the liquid pump are non-limiting.

The bottom portion 160 of the liquid has a generally cylindrical shape body 162 which has upper and lower tapered ends 164, 166; however, it can be appreciated that the bottom portion can have many other shapes. The bottom portion is generally formed of a plastic material; however, other or additional materials can be used to form all or a portion of the bottom portion. The length of the bottom portion is non-limiting. In one non-limiting design, the bottom portion has a length of about 0.5-5 inches, typically about 1-4 inches, and more typically about 1-3 inches. The cross-section size and shape of the bottom portion is also non-limiting. In one non-limiting design, when the bottom portion has a circular cross-section shape, the diameter is about 0.25-2 inches, typically about 0.5-1.5 inches, and more typically about 0.5-1 inches. The cross-sectional size and/or shape of the bottom portion can be constant or vary along the longitudinal length or central axis of the bottom portion.

Figure 3:
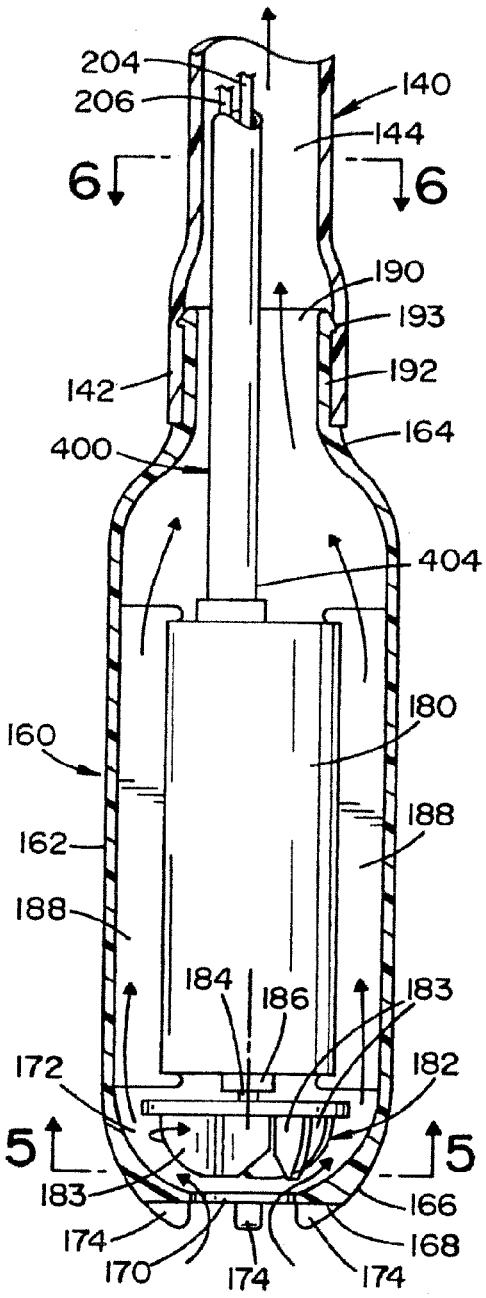
FIG. 3 is a cross-sectional view along line 3-3 of FIG. 2.
Figure 4:
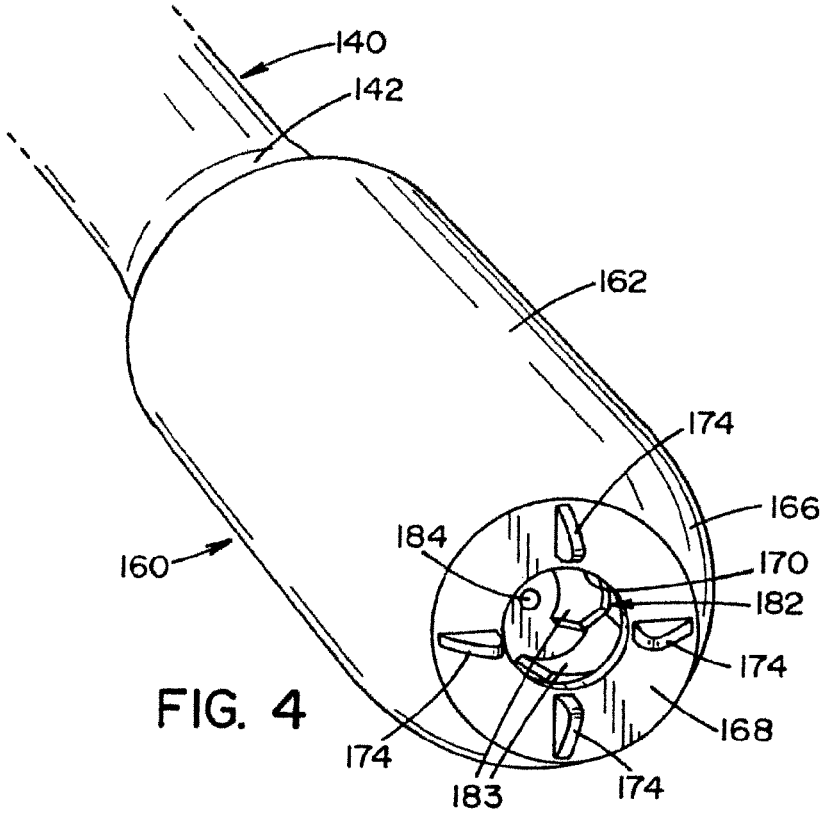
FIG. 4 is an enlarged elevation view of the bottom portion and lower portion of the elongated body of the liquid pump of FIG. 1.

As best illustrated in FIGS. 3 and 4, the bottom end 168 of the bottom portion 160 includes an opening 170. As can be appreciated, the bottom portion can include more than one opening; however, this is not required. As can also be appreciated, the opening can be located in other or additional locations on the bottom portion; however, this is not required. The opening 170 is designed to enable fluid, not shown, in a container C to be drawn to the interior 172 of the bottom portion. The bottom portion is illustrated as including a centrally located circular opening in the bottom end; however, it can be appreciated that 1) the opening can have shapes other than a circular shape, 2) the opening does not have to be in the center of the bottom end, 3) the bottom portion can include more than one opening, 3) one or more openings can be positioned on the side of the bottom portion, and/or 4) an opening does not need to be positioned at the bottom end of the bottom portion. One or more base ribs 174 can be optionally connected to or formed on the bottom end of the bottom portion. The base ribs can be used to elevate the bottom end from a bottom surface of a container when the bottom portion is placed into a container. The spacing of the bottom end 168 from the bottom of a container facilitates in preventing the opening 170 to form a seal with the bottom surface of the container and thereby inhibit or prevent fluid in the container form being drawn through the opening 170 and into the interior 172 of the bottom portion. As illustrated in FIG. 4, four ribs 174 are positioned ion the bottom end 168 of the bottom portion. As can be appreciated, when ribs are used, more than four or less than four ribs can be used. The shape of the ribs, when used, are non-limiting.

Figure 5:
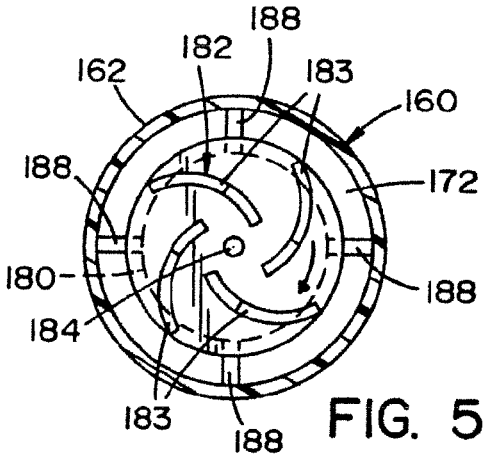
FIG. 5 is a cross-sectional view along line 5-5 of FIG. 3.

Positioned in the interior 172 of the body 162 of the bottom portion 160 is an electric motor 180. The electric motor is designed to rotate a blade 182 which causes fluid in container C to be drawn through opening 170 and into the interior 172 of bottom portion 160 as illustrated by the arrows in FIG. 3. A rotatable shaft 184 is connected between the motor and the blade. A sealing ring 186 can be used to form a liquid seal to inhibit or prevent liquid from contacting the motor and/or entering the interior of the motor. The electric motor in the bottom portion of the liquid pump is generally partially or fully sealed from the fluid that enters the interior of the bottom portion of the liquid pump; however, this is not required. The sealing of the motor has one or more advantages, namely 1) the electric motor is not damaged by the fluid, and/or 2) the fluid is not contaminated by the motor. The blade 182 includes a plurality of fins 183. As illustrated in FIG. 5, the blades can have an arcuate shape to facilitate in drawing liquid into the bottom portion when the motor rotates the blade. A motor mount chamber or brackets 188 can be used to mount the motor in the interior 172 of the bottom portion. As can be appreciated, more than one electric motor can be used to rotate one or more blades. As can also be appreciated, all or a portion of the motor can also or alternatively be positioned in the top portion and/or elongated body of the liquid pump. It has been found that by placing the electric motor fully or partially in the bottom portion of the liquid pump, the sound generated by the operation of the electric motor is significantly muffled, especially when the bottom portion is partially or fully immersed in fluid in a container. Furthermore, by placing the motor in the bottom portion, a smaller profile top portion can be used and a flexible elongated body can be maintained.

A top opening 190 is positioned at or near the upper tapered end 164 of the bottom portion. As illustrated in FIG. 3, a connection flange 192 extends upwardly from tapered end 164 and terminates at top opening 190. The lower end 142 of elongated body 140 is illustrated as being fitted about connection flange 192 to form a connection between the elongated body 140 and the bottom portion 160. As illustrated by the arrows in FIG. 3, when the electric motor 180 rotates blade 182, fluid in the container is drawn into the interior 172 of the bottom portion via opening 170, and then flows upwardly through the interior and out of the bottom portion via top opening 190 and into the inner passageway 144 of the elongated body. As can be appreciated, the bottom portion can include more than one top opening. As can also be appreciated, the size and/or shape of the one or more top openings is non-limiting. Furthermore, the location of the one or more top openings on the bottom portion is non-limiting.

Generally, the lower end of the elongated body is irremovably connected to the bottom portion 160; however this is not required. The elongated body is illustrated as having a generally cylindrical shape; however, the elongated body can have other or additional shapes. The cross-section shape and size of the elongated body is illustrated as being generally uniform along most of the longitudinal length of the elongated body; however, it can be appreciated that the cross-section shape and/or size of the elongated body can vary along the longitudinal length of the elongated body. The length of the elongated body is non-limiting. In one non-limiting design, the elongated body has a length of about 2-20 inches, and typically about 6-14 inches. The cross-section size of the elongated body is also non-limiting. In one non-limiting design, when the elongated body has a circular cross-section shape, the diameter is about 0.25-2 inches, and typically about 0.5-1.25 inches. One or more portions of the elongated body can be designed to be flexible and/or be formed of a flexible material; however, this is not required. When the elongated body is designed to be partially or fully flexible, such a design allows the elongated body to be more conveniently positioned in different shaped and sized containers. In one non-limiting design, the elongated body is formed of a flexible tubular material. The tubular material can be clear, partially clear, or colored to prevent viewing of the interior of the elongated body.

As mentioned above, the interior of the elongated body includes one or more passageways, not shown, to enable fluid to flow from the lower end of the elongated body to the upper end 146 of the elongated body 140. The lower end 142 is illustrated as being stretched about connection flange 192 on the bottom portion. An adhesive can also be used to secure the elongated body to the bottom portion. The outer surface of the connection flange 192 can include one or more connection ribs 193 to facilitate in maintaining the connection between the elongated body and the bottom portion; however, this is not required. As can be appreciated, other or additional arrangements can be used to form a connection between the bottom portion and the elongated portion. Generally, the connection between the bottom portion and the elongated body forms a liquid proof seal; however, this is not required.

Figure 6:
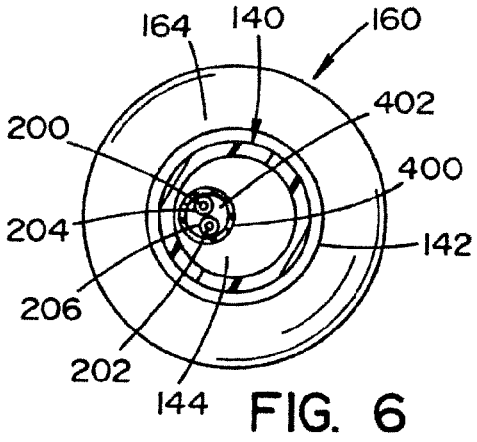
FIG. 6 is a cross-sectional view along line 6-6 of FIG. 3.

The elongated body can include one or more inner passageways. The inner passageway 144 of the elongated body can include one or more electric wires 200, 202; however, this is not required. The electric wires can be coated with an insulating and/or protective material 204, 206; however, this is not required. When power supply 300 for the electric motor is partially or fully positioned in the top portion 110 and/or elongated body 140, one or more electric wires are typically positioned in one or more portions of the inner passageway of the elongated body so as to electrically connect to the electric motor to the power supply. When one or more electric wires are positioned in the inner passageway of the elongated body, the one or more electric wires can be isolated from the fluid in the inner passageways; however, this is not required. The isolation of the one or more electric wires has one or more advantages, namely 1) the one or more electric wires are not damaged by the fluid, and/or 2) the fluid is not contaminated by the one or more electric wires. The isolation of the one or more wires, when used, can be achieved in several ways such as, but not limited to, 1) creating a separate passageway in the interior of the elongated body for the one or more electric wires which separate passageway is not in fluid communication with the one or more passageways for the fluid, 2) encase the one or more electric wires in a tubing or other type of material, which tubing or material, and/or 3) coat the one or more electric wires with a coating (e.g., plastic coating, etc.). As illustrated in FIGS. 3 and 6, the electric wires 200, 202 are coated with a protective/insulative coating 204, 206 and are also positioned in the inner cavity 402 of protective tube 400. The lower end 404 of the protective tube 400 is illustrated as being connected to the top of electric motor 180. Generally, a liquid seal is formed between the lower end of the protective tube and the electric motor; however, this is not required. The top end of the protective tube is designed to be connected to the top portion 110 of the fluid pump. Generally, a liquid seal is formed between the top end of the protective tube and the top portion; however, this is not required. In such an arrangement, the protective tube extends along the full length or nearly the full length of the elongated body. In the non-limiting arrangement illustrated in FIG. 3, the electric wires are positioned in the protective tube so as to isolate the electric wires from any fluid that flows in the inner passageway of the elongated body. The lower end of the protective tube is connected to the electric motor so that fluid flowing from the bottom portion into the elongated body does not enter the tube and/or contact the one or more electric wires. Likewise, the upper end of the protective tube is connected to the top portion of the fluid pump so that fluid flowing in the elongated body into the top portion of the liquid pump does not enter the protective tube and/or contact the electric wires. The protective tube is generally formed of a flexible material; however, this is not required. The electric wires are also generally flexible; however, this is not required.

Referring now to FIGS. 1, 2 and 7-10, the top portion 110 of the liquid pump 100 includes a dispenser head 114 and a dispensing tab 120. The dispensing tab 120 is illustrated by the arrow in FIG. 1 as being pivotally connected to the body 112 of the top portion 110. The dispensing tab is designed to be depressed by a user to move to an actuation position to cause the actuation of the electric motor, which in turn causes fluid to flow into the bottom portion, through elongated body, into the body of top portion and out of dispenser opening 116 of dispenser head 114. The dispensing tab is generally biased in a non-activation position by a biasing arrangement, not shown, such as a spring or the like. When the dispensing tab is in the non-activation position, the electric motor is not actuated by the power supply. As can be appreciated, many other arrangements can be used to enable a user to cause fluid to be dispensed from dispenser opening of dispenser head (e.g., switch, knob, or button on top portion, etc.). The depression of the dispensing tab by a user can be accomplished by the user placing a glass G, or cup or other type of container under the dispenser opening of dispenser head and then manually pressing the dispensing tab or by pushing a portion of the glass G into the dispensing tab as illustrated in FIG. 1. As shown in the FIG. 1, glass G is pressed into the front face 121 of the dispensing tab to cause the dispensing tab to pivot from a non-actuation position to an actuation position. The front face of the dispensing tab can optionally include one or more ribs 122 that can be used to facilitate in the engagement of the glass with the dispenser tab and facilitate in a user manually pushing the dispenser tab; however, this is not required. As can be appreciated, the dispensing tab can be actuated by a user in other or additional ways.

The body 112 of the top portion 110 of the liquid pump 100 has a generally square cross-sectional shape; however, it will be appreciated that body can have many different shapes and/or sizes. The maximum cross-sectional size of the body is generally selected so that the body cannot be inserted through the opening of a container C; however, this is not required. Such a design can be used to prevent the top portion from inadvertently falling inside the container. Most beverage containers that are used to hold fluids for human consumption have openings that are between about 0.5-3 inches. Generally, the maximum cross-sectional size of the body is selected so that the body of the top portion cannot be inserted through an opening of a container having a diameter of less than 5 inches, typically less than 4 inches, more typically less than 3 inches, and even more typically less than about 2.5 inches. However, with respect to the bottom portion and the elongated body, the maximum cross sectional size is generally selected so that the bottom portion and the elongated body can fit through an opening in a container C. Generally, the maximum cross-sectional size of the bottom portion is selected so that the bottom portion can be fully inserted through an opening of a container having a diameter of less than 5 inches, typically less than 4 inches, more typically less than 3 inches, even more typically less than about 2.5 inches, still even more typically less than about 1.5 inches, yet still even more typically less than about 1 inch, and still even more typically less than about 0.75 inch. For example, if the diameter of the opening in the top of a container was about 0.75 inches, and the bottom portion had a circular cross-sectional shape, then the maximum diameter of the bottom portion would be selected to be less than 0.75 inches so that the bottom portion can be easily inserted through the opening in the container. Likewise, the portion of the elongated body that is designed to be inserted into a container also has a maximum cross-sectional size for such portion so that such portion of the elongated body can be fully inserted through an opening of a container having a diameter of less than 5 inches, typically less than 4 inches, more typically less than 3 inches, even more typically less than about 2.5 inches, still even more typically less than about 1.5 inches, yet still even more typically less than about 1 inch, and still even more typically less than about 0.75 inch. For example, if the diameter of the opening in the top of a container was about 0.75 inches, and the portion of the elongated body to be inserted into the container had a circular cross-sectional shape, then the maximum diameter of the such portion of the elongated body would be selected to be less than 0.75 inches so that such portion of the elongated body can be easily inserted through the opening in the container.

The dispenser head 114 is illustrated as being positioned on the top surface of body 112; however, it will be appreciated that the dispenser head can be positioned on other or additional regions of the body of the top portion. Likewise, dispensing tab 120 is illustrated as being positioned on the front face of body 112; however, it will be appreciated that the dispensing tab 120 can be positioned on other or additional regions of the body 112. As can further be appreciated, the size and/or shape of the dispenser head and the dispensing tab is non-limiting. The dispenser head can be rotatably connected to body 112; however, this is not required. The dispensing tab, body of the top portion, and/or the dispenser head can include a safety feature (e.g., tab lock, deactivation switch, dispenser head lock and unlock position, etc.) to prevent inadvertent actuation of the electric motor by a user; however this is not required.

Figure 9:
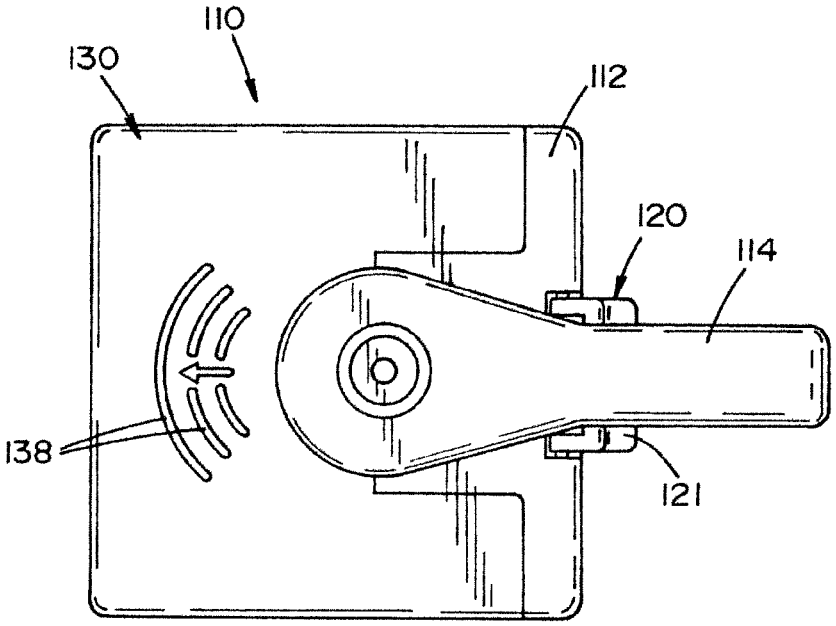
FIG. 9 is a top view of the liquid pump illustrated in FIG. 1.
Figure 10:
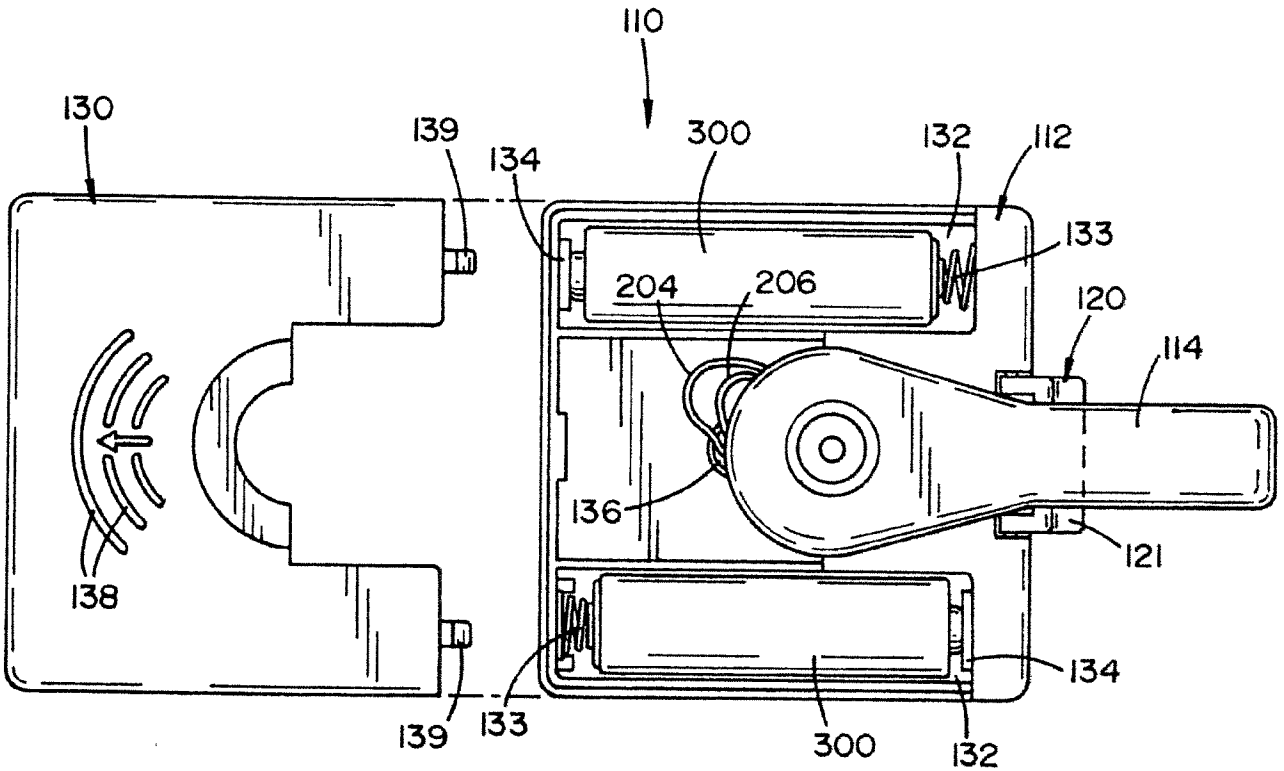
FIG. 10 is a top view of the liquid pump illustrated in FIG. 9 wherein in the battery cover is removed.

As best illustrated in FIGS. 9 and 10, the body 112 of the top portion includes a battery cover 130 that is movable to enable a user to access the battery cavity 132 in the body of the top portion. Two battery cavities are illustrated; however, it will be appreciated that more than two or less than two battery cavities can be positioned on the top portion. The two battery cavities are positioned on each side of the dispenser head. Such a positioning facilitates in maintaining a low profile for the top portion. Positioned in the battery cavity are power supplies 300 in the form of two batteries. The power supply is designed to supply electrical power to the electric motor when the dispensing tab is actuated by a user. As can be appreciated, the one or more battery cavities can include more than two batteries or less than two batteries. As can also be appreciated, the orientation of the one or more batteries in the battery cavity and the top portion is non-limiting. As can also be appreciated, the type of batteries used to power the electric motor is non-limiting. Each of the battery cavities includes electric connectors 133, 134. The electric connectors are connected to two wires that are used to supply power to the electric motor in the bottom portion. The electric wires are illustrated as passing through a bottom opening 136. Protective tube 400 is designed to be connected to bottom opening 136.

As illustrated in FIG. 10, the battery cover 130 is designed to be fully removable from body 112; however, this is not required. The top surface of the battery cover 130 can optionally include one or more ribs 138 or other type of gripping structures to facilitate in the moving of the battery cover on the body so that a user can access the battery cavity; however, this is not required. The top of the battery cover 130 also includes an optional arrow that functions as a visual indicator to inform a user how to open the battery cover. The battery cover can optionally include one or more connection tabs 139 that can be used to connect the battery cover to the body 112.

Referring now to FIGS. 1-3, 7 and 8, a connector adaptor 150 is connected to the bottom surface of body 112. The connector adaptor is an optional component of the fluid pump. The connector adaptor is designed to maintain the top portion of the liquid pump on one or more fluid containers C. Many different containers have different sized openings that allow a user to pour a liquid from the container. The connector adaptor is designed to maintain the liquid pump on a variety of sized openings. The connector adaptor can also be designed to form a liquid seal between the top opening of container and the liquid pump; however, this is not required.

The connector adaptor 150 can be removably or irremovably secured to the bottom surface of body by a variety of means (e.g., adhesive, clamp, thread, snap ring, friction connection, etc.). The connector adaptor is illustrated is having two tabs 152; however, this is not required. As can be appreciated, more than two or less than two tabs can be used. The tabs, when used, allow a user to easily grasp a portion of the connector adaptor to position the connector adaptor about an opening in a container and/or to remove the connector adaptor from an opening of a container.

Figure 7:
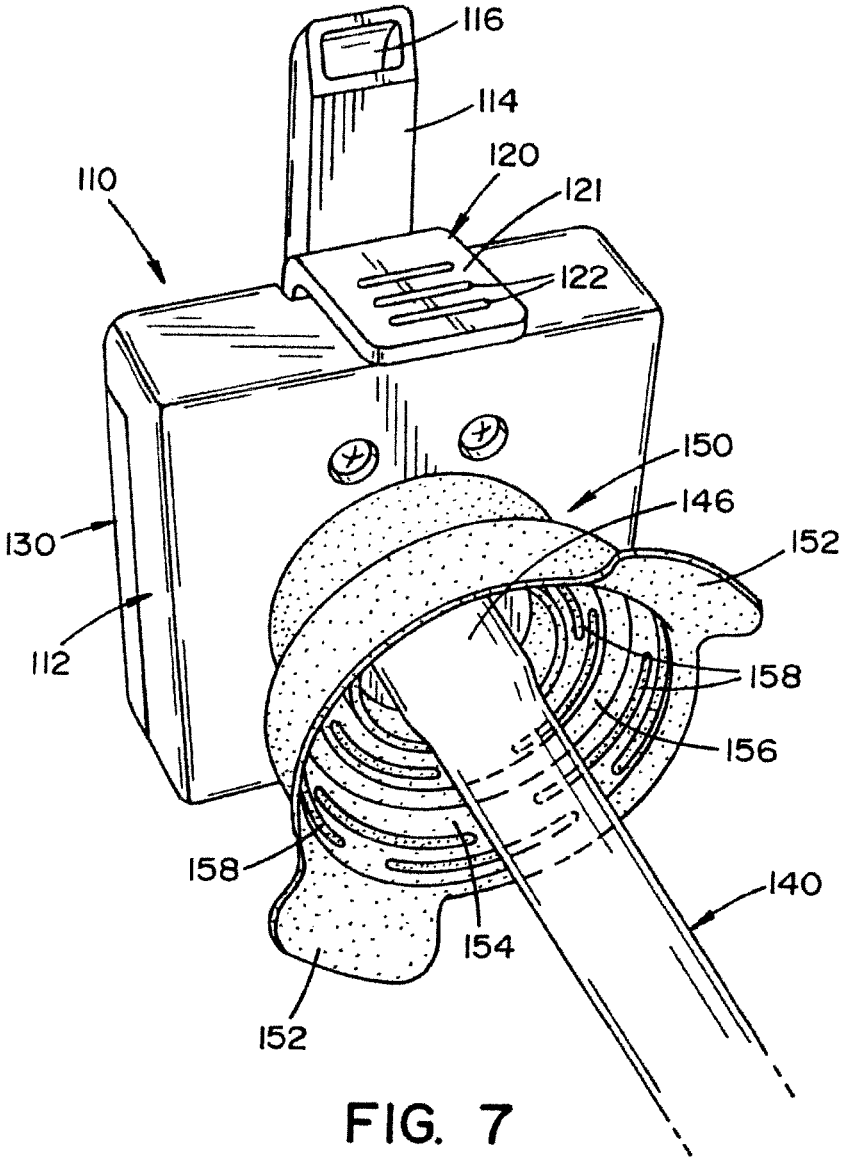
FIG. 7 is an enlarged elevation view of the top portion and upper portion of the elongated body of the liquid pump of FIG. 1.

As best illustrated in FIG. 7, the interior cavity 154 of the connector adaptor decreases in diameter along the longitudinal length of the connector adaptor from the bottom to the top of the connector adaptor; however, this is not required. The interior cavity also includes one or more landing ribs 156 along the longitudinal length of the connector adaptor; however, this is not required. The varying diameter of the interior cavity at the lower portion of the connector adaptor enables the connector adaptor to be fitted on different sized openings on different types of containers. The landing ribs, when used, are designed to engage the top lip of an opening of a container when the connector adaptor is fitted on the container opening so as to form a tighter and/or more secure connection between the connector adaptor and the container. As can be appreciated, the landing ribs and the varying diameter of the interior cavity 154 are optional features of the connector adaptor. As can also be appreciated, the interior cavity can also or alternatively include a threaded portion 158 to enable the connector adaptor to be threaded on a top opening of a container; however, this is not required.

Figure 8:
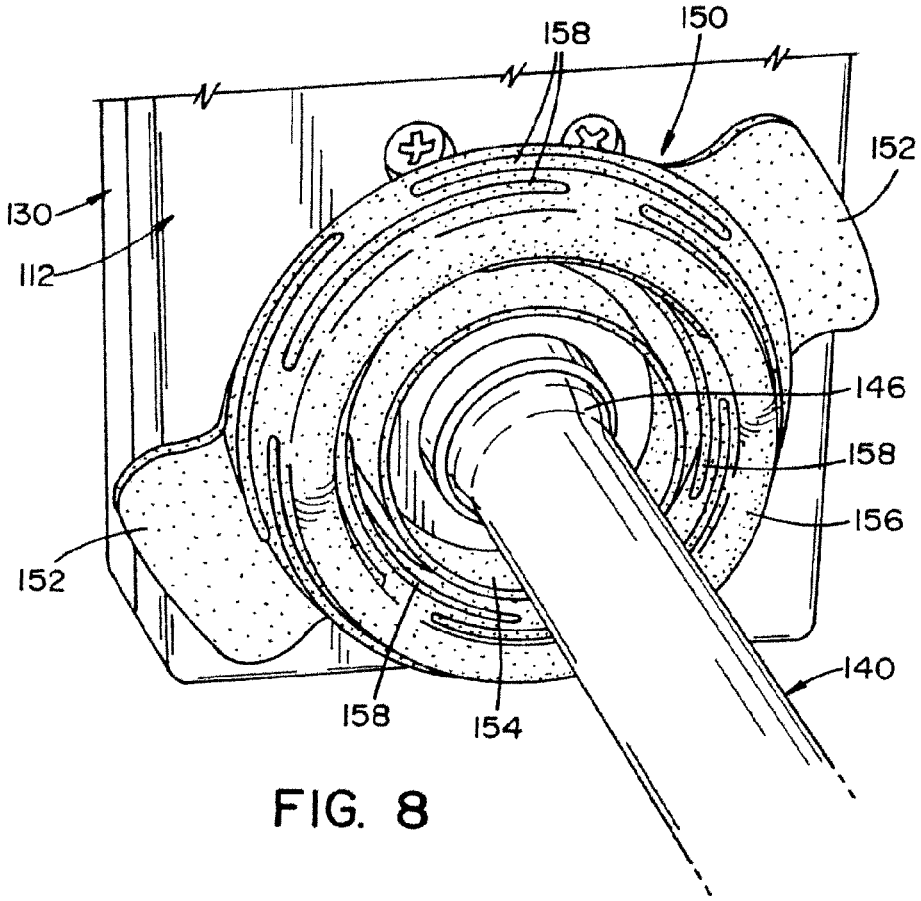
FIG. 8 is an enlarged elevation view of the bottom of the top portion and upper portion of the elongated body of the liquid pump of FIG. 7 which illustrated the connector adaptor in a rolled-up position.

When a user is preparing to fit the connector adaptor on the top opening of a container, the user can grasp tabs 152 and pull the tabs toward the bottom surface of body 112 of the top portion. The flexible material of the connector adaptor results in the side walls of the interior cavity to be rolled up as illustrated in FIG. 8. As can be appreciated, the connector cavity does not have to be formed of a flexible material. Furthermore, the connector cavity does not have to be designed to enable the walls of interior cavity to be rolled up. Referring again to FIG. 8, once the side walls of interior are partially or fully rolled up, a user can then place the bottom portion 160 and elongated body 140 into container C as illustrated in FIG. 1, and then place the connector adaptor on the top opening of the container. Thereafter, the user may grasp the tabs 152 and pull the tabs downwardly about the top portion of the container; however, this is not required. In another arrangement, the interior cavity can include two sets of thread for connection to two different sized container openings. For larger container openings, the walls of the interior cavity are not rolled-up, and the connector adaptor is threaded onto the container. For smaller container openings, the side walls of the interior cavity are rolled-up so that the thread positioned in the narrower portion of the interior cavity can be threaded onto the container. When neither thread arrangement in the interior cavity cannot be used, the tabs on the connector adaptor can be used to stretch the interior cavity about a container opening so as to secure the liquid pump to the container.

The connector adaptor can be designed to be removably connected to the top portion of the liquid pump so that a variety of adaptors can be connected to top portion, and/or to facilitate in the cleaning of one or more components of the liquid pump; however, this is not required.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

I claim:

1. A method for converting a portable container into a portable container having a fountain drink dispenser comprising:

providing a portable container, said portable container having a top opening that provides access to an internal cavity of said portable container, said internal cavity having a capacity of one quart to five gallons;

providing a liquid pump, said liquid pump removably connectable to said top opening of said portable container and to form a liquid seal between said liquid pump and said top opening of said portable container when said liquid pump is connected to said portable container; said liquid pump including a single top portion, a single elongated body, a single bottom portion, a single electric motor and a power supply designed to power said single electric motor; said electric motor supported in the bottom portion and designed to draw fluid into said single bottom portion, through said single elongated body and to said single top portion when said electric motor is activated, said single bottom portion fluidly connected to said single elongated body and said single elongated body fluidly connected to said single top portion such that when fluid is drawn into said single bottom portion, the fluid can flow out of said single bottom portion and into said single elongated body and then out of said single elongated body and into said single top portion; said top portion including a single dispenser activator and a single dispenser head, said single dispenser activator designed to activate said electric motor, said single dispenser head designed to enable fluid that flows to said single top portion to exit said single top portion through said single dispenser head; a majority of said elongated body includes a single piece flexible tube;

inserting said single bottom portion and at least a portion of said single elongated body through said top opening of said portable container until said single top portion is positioned on said top opening of said portable container and said single bottom portion is at least partially submerged in liquid;

removably securing said single top portion of said liquid pump to said top opening of said portable container to form said liquid seal between said liquid pump and said portable container; and, actuating said single dispenser activator so that power from said power supply energizes said single electric motor to cause fluid in said cavity of said portable container to be drawn into said single bottom portion through one or more openings in said single bottom portion, and then through said single bottom portion and into said single elongated body, and then through said single elongated body and into said single top portion, and out through said single dispenser head.

2. The method as defined in claim 1, wherein said step of actuating said single dispenser activator includes positioning a glass or cup under an opening in said single dispenser head while simultaneously moving the glass or cup into contact with said dispenser activator which contact by said glass or cup causes said actuation of said single dispenser activator, said single dispenser activator includes a pivotable tab that is movable between an activation position that causes said electric motor to activate and a deactivation position that causes said electric motor to deactivate, said pivotable tab biased in said deactivation position, said pivotable tab positioned below at least a portion of said single dispenser head.

3. The method as defined in claim 1, wherein said liquid pump includes a single flexible connector adaptor secured to a bottom portion of said single top portion of said liquid pump, said single flexible connector adaptor including a cavity having a plurality of cross-section sizes to enable said cavity to connect to a plurality of different sized openings on different portable containers, at least a portion of a wall of said cavity is flexible, said flexible wall of said cavity including at least one grasping tab extending downwardly from said flexible wall, said flexible wall can be rolled up onto itself, said step of removably securing said single top portion of said liquid pump to said top opening of said portable container including inserting at least a portion of said single flexible connector adaptor about said top opening of said portable container when said liquid pump is removably connected to said portable container, said single flexible connector at least partially forming said liquid seal.

4. The method as defined in claim 2, wherein said liquid pump includes a single flexible connector adaptor secured to a bottom portion of said single top portion of said liquid pump, said single flexible connector adaptor including a cavity having a plurality of cross-section sizes to enable said cavity to connect to a plurality of different sized openings on different portable containers, at least a portion of a wall of said cavity is flexible, said flexible wall of said cavity including at least one grasping tab extending downwardly from said flexible wall, said flexible wall can be rolled up onto itself, said step of removably securing said single top portion of said liquid pump to said top opening of said portable container including inserting at least a portion of said single flexible connector adaptor about said top opening of said portable container when said liquid pump is removably connected to said portable container, said single flexible connector at least partially forming said liquid seal.

5. The method as defined in claim 3, wherein said flexible wall is designed to be rolled up onto itself, and further including the step of at least partially rolling up said flexible wall prior to securing said liquid pump to said portable container and then unrolling said flexible wall about said top opening of said portable container once said single top portion of said liquid pump is positioned in said portable container.

6. The method as defined in claim 4, wherein said flexible wall is designed to be rolled up onto itself, and further including the step of at least partially rolling up said flexible wall prior to securing said liquid pump to said portable container and then unrolling said flexible wall about said top opening of said portable container once said single top portion of said liquid pump is positioned in said portable container.

7. The method as defined in claim 1, wherein said single bottom portion fully contains said single electric motor and said single top portion fully contains said power supply, at least a portion of an electrical connection is positioned inside said single elongated body and is isolated from fluid flowing through said single elongated body as fluid flows from said single bottom portion through said single elongated body portion and to said single top portion.

8. The method as defined in claim 6, wherein said single bottom portion fully contains said single electric motor and said single top portion fully contains said power supply, at least a portion of an electrical connection is positioned inside said single elongated body and is isolated from fluid flowing through said single elongated body as fluid flows from said single bottom portion through said single elongated body portion and to said single top portion.

9. The method as defined in claim 1, wherein a bottom end of said single elongated body is connected to a top end of said single bottom portion, said single bottom portion and said single elongated body have a longitudinal length and a maximum width, said longitudinal length of said single bottom portion less than said longitudinal of said single elongated body, said maximum width of said single bottom portion greater than said maximum width of said single elongated body, said single bottom portion includes a bottom opening and a plurality of base ribs extending downwardly from a bottom surface of said single bottom portion, said base ribs designed to prevent sealing of said bottom opening with a bottom surface of cavity of said portable container when said single bottom portion is placed in said cavity of said portable container.

10. The method as defined in claim 8, wherein a bottom end of said single elongated body is connected to a top end of said single bottom portion, said single bottom portion and said single elongated body have a longitudinal length and a maximum width, said longitudinal length of said single bottom portion less than said longitudinal said single elongated body, said maximum width of said single bottom portion greater than said maximum width of said single elongated body, said single bottom portion includes a bottom opening and a plurality of base ribs extending downwardly from a bottom surface of said single bottom portion, said base ribs designed to prevent sealing of said bottom opening with a bottom surface of cavity of said portable container when said single bottom portion is placed in said cavity of said portable container.

11. The method as defined in claim 1, wherein said single dispenser head includes an upwardly angled internal passageway to inhibit or prevent flow of liquid through an opening in said single dispenser head after said motor is deactivated, said angle about 0.5-10°.

12. The method as defined in claim 10, wherein said single dispenser head includes an upwardly angled internal passageway to inhibit or prevent flow of liquid through an opening in said single dispenser head after said motor is deactivated, said angle about 0.5-10°.

13. The method as defined in claim 1, wherein said single top portion includes a removably connected power supply cover positioned in a top surface of said single top portion, said removably connected power supply cover designed to enable a user to access and replace said power supply located in said single top portion without having to disconnect said liquid pump from said portable container.

14. The method as defined in claim 12, wherein said single top portion includes a removably connected power supply cover positioned in a top surface of said single top portion, said removably connected power supply cover designed to enable a user to access and replace said power supply located in said single top portion without having to disconnect said liquid pump from said portable container.

15. A method for converting a portable container into a portable container having a fountain drink dispenser comprising:

providing a portable container, said portable container having a single top opening that provides access to an internal cavity of said portable container, said internal cavity having a capacity of one quart to five gallons;

providing a liquid pump, said liquid pump removably connectable to said top opening of said portable container and to form a liquid seal between said liquid pump and said top opening of said portable container when said liquid pump is connected to said portable container; said liquid pump including a single top portion, a single elongated body, a single bottom portion, a single electric motor supported in the single bottom portion and a power supply designed to power said single electric motor; said electric motor designed to draw fluid into said single bottom portion, through said single elongated body and to said single top portion when said electric motor is activated, said single bottom portion fluidly connected to said single elongated body and said single elongated body fluidly connected to said single top portion such that when fluid is drawn into said single bottom portion, the fluid can flow out of said single bottom portion and into said single elongated body and then out of said single elongated body and into said single top portion; said top portion including a single dispenser activator and a single dispenser head, said single dispenser activator designed to activate said electric motor, said single dispenser head designed to enable fluid that flows to said single top portion to exit said single top portion through said single dispenser head; a majority of said elongated body includes a single piece flexible tube, said single bottom portion fully contains said single electric motor and said single top portion fully contains said power supply, at least a portion of an electrical connection is positioned inside said single elongated body and is isolated from fluid flowing through said single elongated body as fluid flows from said single bottom portion through said single elongated body portion and to said single top portion, said single dispenser head includes an upwardly angled internal passageway to inhibit or prevent flow of liquid through an opening in said single dispenser head after said motor is deactivated, said angle about 0.5-10';

inserting said single bottom portion and at least a portion of said single elongated body through said top opening of said portable container until said single top portion is positioned on said top opening of said portable container and said single bottom portion is at least partially submerged in liquid;

removably securing said single top portion of said liquid pump to said top opening of said portable container to form said liquid seal between said liquid pump and said portable container; and, actuating said single dispenser activator so that power from said power supply energizes said single electric motor to cause fluid in said cavity of said portable container to be drawn into said single bottom portion through one or more openings in said single bottom portion, and then through said single bottom portion and into said single elongated body, and then through said single elongated body and into said single top portion, and out through said single dispenser head, said step of actuating said single dispenser activator includes positioning a glass or cup under an opening in said single dispenser head while simultaneously moving the glass or cup into contact with said dispenser activator which contact by said glass or cup causes said actuation of said single dispenser activator, said single dispenser activator includes a pivotable tab that is movable between an activation position that causes said electric motor to activate and a deactivation position that causes said electric motor to deactivate, said pivotable tab biased in said deactivation position, said pivotable tab positioned below at least a portion of said single dispenser head.

16. The method as defined in claim 15, wherein said liquid pump includes a single flexible connector adaptor secured to a bottom portion of said single top portion of said liquid pump, said single flexible connector adaptor including a cavity having a plurality of cross-section sizes to enable said cavity to connect to a plurality of different sized openings on different portable containers, at least a portion of a wall of said cavity is flexible, said flexible wall of said cavity including at least one grasping tab extending downwardly from said flexible wall, said flexible wall can be rolled up onto itself, said step of removably securing said single top portion of said liquid pump to said top opening of said portable container including inserting at least a portion of said single flexible connector adaptor about said top opening of said portable container when said liquid pump is removably connected to said portable container, said single flexible connector at least partially forming said liquid seal.

17. The method as defined in claim 16, wherein said flexible wall is designed to be rolled up onto itself, and further including the step of at least partially rolling up said flexible wall prior to securing said liquid pump to said portable container and then unrolling said flexible wall about said top opening of said portable container once said single top portion of said liquid pump is positioned in said portable container.

18. The method as defined in claim 15, wherein a bottom end of said single elongated body is connected to a top end of said single bottom portion, said single bottom portion and said single elongated body have a longitudinal length and a maximum width, said longitudinal length of said single bottom portion less than said longitudinal of said single elongated body, said maximum width of said single bottom portion greater than said maximum width of said single elongated body, said single bottom portion includes a bottom opening and a plurality of base ribs extending downwardly from a bottom surface of said single bottom portion, said base ribs designed to prevent sealing of said bottom opening with a bottom surface of cavity of said portable container when said single bottom portion is placed in said cavity of said portable container.

19. The method as defined in claim 15, wherein said single top portion includes a removably connected power supply cover positioned in a top surface of said single top portion, said removably connected power supply cover designed to enable a user to access and replace said power supply located in said single top portion without having to disconnect said liquid pump from said portable container.

* * * * *